US005212975A

United States Patent [19]

Ginzburg

[11] Patent Number: 5,212,975

[45] Date of Patent: May 25, 1993

[54] METHOD AND APPARATUS FOR COOLING ROLLING MILL ROLLS AND FLAT ROLLED PRODUCTS

[75] Inventor: Vladimir B. Ginzburg, Pittsburgh, Pa.

[73] Assignees: International Rolling Mill Consultants, Inc.; United Engineering, Inc., both of Pittsburgh, Pa.

[21] Appl. No.: 781,981

[22] Filed: Oct. 24, 1991

Related U.S. Application Data

[63] Continuation-in-part of Ser. No. 699,203, May 13, 1991, abandoned.

[51] Int. Cl.[5] ..... B21B 27/10; B21B 45/02

[52] U.S. Cl. ..... 72/43; 72/201; 72/236; 72/13; 239/562

[58] Field of Search ..... 72/13, 39, 43, 201, 72/236; 239/562

[56] References Cited

U.S. PATENT DOCUMENTS

| | | | |
|---|---|---|---|
| 3,151,197 | 9/1964 | Schultz | 72/201 |
| 3,237,872 | 4/1965 | Mincy | 239/562 |
| 3,656,330 | 4/1972 | Brown et al. | 72/10 |
| 3,826,431 | 7/1974 | Telge | 239/170 |
| 4,226,108 | 10/1980 | Wilmotte et al. | 72/236 |
| 4,256,168 | 3/1981 | Hein et al. | 72/201 |
| 4,392,367 | 7/1983 | Bald | 72/12 |
| 4,612,788 | 9/1986 | Kitagawa | 72/13 |
| 4,638,654 | 1/1987 | Lubrano | 72/201 |
| 4,706,480 | 11/1987 | Svatos | 72/17 |
| 4,750,343 | 6/1988 | Richter et al. | 72/201 |
| 4,796,450 | 1/1989 | Blazevic | 72/201 |
| 4,912,955 | 4/1990 | Stines | 72/45 |

FOREIGN PATENT DOCUMENTS

| | | | |
|---|---|---|---|
| 1433490 | 4/1976 | United Kingdom | 72/10 |

OTHER PUBLICATIONS

Vidiplan Automatic Shape Control of Steel Flat Products—Davy McKee (Sheffield) Ltd., 1987.

*Primary Examiner*—Lowell A. Larson
*Assistant Examiner*—Thomas C. Schoeffler
*Attorney, Agent, or Firm*—Armstrong, Westerman, Hattori, McLeland & Naughton

[57] ABSTRACT

One or more spray bars having a plurality of spray nozzles for cooling a rolling mill roll are provided with an apparatus to cause at least one spray bar to undergo a translational, rotational, and/or pivotal movement sufficient to change the spray-angle and/or spray-distance affected by nozzles thereon to thereby control the cooling rate effected by the nozzles so moved. The spray bar can be automatically controlled by providing a means for monitoring the roll condition and/or workpiece condition and means responsive thereto for moving the spray bar as necessary to change and adjust individual cooling rates effected by the nozzles and correct for any undesired result so monitored. A unique spray bar has nozzles arranged in a curved alignment so that each effects a different spray-angle and/or spray-distance. Like apparatus and comparable methods can be utilized to cool a hot rolled product.

44 Claims, 9 Drawing Sheets

METHOD AND APPARATUS FOR COOLING ROLLING MILL ROLLS AND FLAT ROLLED PRODUCTS

CROSS-REFERENCE TO RELATED APPLICATIONS

This application is a Continuation-In-Part of patent application Ser. No. 07/699,203, filed May 13, 1991 now abandoned.

BACKGROUND OF THE INVENTION

1. Field of the Invention

This invention relates generally to the water cooling of rolling mill rolls, and more particularly, to a simple and inexpensive method and apparatus for automatically controlling the cooling rates within various zones of the rolling mill roll or even a hot rolled product exiting a hot roll stand. The invention provides a simple and more reliable control of cooling rates by providing a plurality of nozzles on a spray bar, each providing a continuous and fixed spray of liquid coolant onto the roll or hot rolled product, and automatically adjusts the position of the spray bar with regard to the roll or product being cooled, thereby adjusting the spray-angles, spray-distances, or both, to effect cooling rate adjustments as necessary.

2. Description of the Prior Art

In modern metal rolling mills, there are a variety of differing rolling processes and procedures for producing finished and semi-finished metal products. Typically, heated slabs or billets, (steel or aluminum, for example) produced by continuous casting machines are hot rolled through one or more roll stands to produce finished or semi-finished products, such as plates, structural products, bars, rods, hot strips and the like. Further finishing steps may include cold rolling such as the cold rolling of hot strip to sheet products. Such roll stands generally comprise at least one pair of rolls between which the metal workpiece is passed to reduce and/or shape the metal workpiece as desired.

During the metal rolling operation, mill rolls are continuously heated by a work heat due to the plastic deformation of the rolled metal, a frictional heat generated between the rolled metal and the rolls, and, in the case of hot rolling, heat transfer from hot metal workpiece. Particularly in the case of hot rolling steel where the steel to be rolled is preheated to temperatures in excess of 1200 C., roll heating as a result of heat transfer can become rather excessive.

Because of such roll heating, it is essential in practically all metal rolling operations that means be provided to cool the rolls during use and thereby prevent unwanted thermal expansion of the rolls, which can adversely affect the quality of the rolled product. For example, in the hot rolling of flat rolled products such a plates, strip and sheet, the rolls tend to become excessively heated in their mid-portion in contrast to the edge portions, causing the diameter of the rolls to increase to a greater extent in the mid-portion, and therefore roll a thinned mid-section into the product as compared to the outer sections. In addition, excessively heated rolls will wear more quickly and tend to stick to the rolled metal surface to adversely affect the surface quality of the rolled product.

While numerous differing types of apparatus have been utilized to cool the rolls, most have been based on the provision of a line of coolant spray nozzles spaced along a side surface of the roll parallel to the roll axis, and positioned on either or both the entrance and/or exit side of the roll. Typically, an elongated spray bar; i.e., manifold or header, having a width generally equal to the width of the roll, is closely positioned parallel to the roll, which has a plurality of equally spaced spray nozzles to direct the water or other coolant from the manifold to the rotating roll. It is well known that the cooling rate is not only a function of the amount of coolant sprayed, but also the spray-distance and spray-angle of the coolant sprayed onto the roll. Accordingly, the nozzle distances from the roll and its spray-angles are normally fixed and uniform to provide optimum angle and distance parameters.

While most rolls tend to be uniformly heated circumferentially, they are not normally heated uniformly in the elongated or axial direction, as noted above. Therefore, it is preferred that the coolant nozzles do not uniformly cool the roll across their axial width, but rather achieve a cooling rate in the various circumferential zones of the roll in proportion to the heating rate within the various zones. Specifically, the individual nozzles should be regulated to concentrate the cooling rate at those circumferential areas of the roll which are subjected to higher heating rates (e.g. the center portion of the roll in the case of rolling flat rolled products) so that the overall temperature of the roll surface can be maintained at a reasonably uniform level. Such an effort is essential if nonuniform thermal expansion is to be prevented and proper roll profile maintained to assure proper dimensions and form of the rolled products.

Accordingly, most cooling systems comprise localized (or segmented) systems to effect differing cooling rates within different zones of the rolls. While it is possible to utilize nozzles having different orifice diameters, or provide a varied spacing between the nozzles, the desired cooling rate profile will normally change from time to time, particularly as the rolled product is continually changing its profile and dimensions. The most practical of the prior art systems, therefore, have utilized nozzles having remotely controlled on/off valves so that the cooling rates in the various roll zones can be controlled by selectively turning certain valves on and certain valves off. Typically, the coolant manifold or spray bar is divided into multiple segments, with each segment containing several nozzles. By selecting an appropriate number of properly positioned nozzles to be turned on, a proper coolant flow pattern can be selected to achieve a suitable cooling rate for each zone. Some such systems utilize a closed-loop control which can turn valves on and off in response to a need to change the cooling rate in any one or more particular segments.

While such cooling systems are generally satisfactory, they do leave a lot to be desired. The most notable problem being the fact that the on/off valves are rather intricate and do not always function properly in the harsh hot rolling mill environment. If a valve remains off or on for a considerable period of time, the heat in the vicinity may at times cause it to "freeze" in that off or on position, or process debris may plug a closed nozzle so that it cannot thereafter be reopened. Accordingly, the reliability of the valved nozzles is quite unsatisfactory, and leads to either considerable down-time to repair or replace one or more nozzles, or less than optimum cooling rate control of the rolls.

Another short-coming of the prior art systems is that since the manifolds and nozzles are fixed, the spray-distances and spray-angles are fixed, as noted above. If only one set of rolls is ever utilized in a particular roll stand, there is no particular problem. With regard to many roll stands, however, it is common practice to change the rolls from time to time for purposes of rolling different products which requires exchanging one set of rolls for a set of rolls of a different diameter. Therefore, since the spray-distances and spray-angles are fixed at optimum parameters for one given set of rolls, they will not be at optimum positions when rolls of a different diameter are substituted.

SUMMARY OF THE INVENTION

This invention is predicated upon a new and improved system for cooling rolling mill rolls which overcomes the above noted problems. The unique new system of this invention utilizes a closed loop feed-back control for continuously regulating and controlling one or more coolant spray bars to continuously maintain a controlled cooling rate within each zone or portion of the roll in response to the temperature profile of the roll and/or the profile and flatness of the rolled product. The reliability of the system is greatly improved by utilizing at least one movable coolant spray bar having a plurality of nozzles which, when in operation, are always in the "on" condition; i.e., provide a continuous spray and do not include any complicated on/off valve. Rather than controlling the amount of coolant utilized, the apparatus of this invention utilizes a fixed coolant flow rate and volume, and instead varies and regulates the spray-angle and/or spray-distance of various selected nozzles by virtue of a predetermined movement of at least one spray bar position to achieve whatever cooling rate is desired. The spray bar movement can be translational within a plane, rotational on the axis of the spray bar, pivotal about a pinned location, or a combination of these movements, any of which will provide an adjustment of the spray bar to vary the spray-angles, spray-distances or both, and accordingly change the cooling rate within one or more zones of the roll. Accordingly, the cooling rates across the widths of the rolls can be varied as desired without the need to turn-on or turn-off the coolant flow to any one or more nozzles.

Since the nozzles are always "on", their construction is quite simple without including any moving parts such as a valve, while the continuous flow of coolant tends to prevent the nozzles from being plugged by debris from the process or being frozen in an unchangeable condition. Although the system of this invention does, nevertheless, include a means for moving at least one spray bar position, which does include moving parts, the means for moving the spray bar is of significantly heavier and more robust construction than the nozzle on/off valves, such that it can readily withstand the harsh environment to which it is subjected and be characterized by a failure rate that is quite low.

In addition to the above, the unique movable spray bar cooling system of this invention can be utilized to advantage in the cooling of flat rolled products such as plate, strip and sheet. Indeed, by utilizing one or more spray bars having a plurality of spray nozzles, the cooling rate of the products can be controlled by moving the spray bar translationally, rotationally, pivotally, or a combination of such motions, not only to uniformly change the cooling rate of the product, but to achieve differing cooling rates within differing portions of the product.

DETAILED DESCRIPTION OF THE INVENTION

It is well known that the heat transfer rate effected by any spray system is a function of the difference in temperature between the rolling mill roll and the coolant. Accordingly, the instantaneous cooling rate q at which heat is removed from a unit area of the roll surface is, on the basis of Newton's law of cooling, proportional to the difference between the roll surface temperature $T_s$ and the coolant temperature $T_c$ and the heat transfer coefficient h. Thus, for a unit of the roll surface, $$q=h(T_s-T_c).$$

It is generally well known that the heat transfer coefficient h is dependant on a great number of variables such as volume of coolant per unit of time, the distance between the nozzle and the roll, the angle of the spray to the roll surface, as well as other variables. As previously noted, the cooling rate controls in prior art cooling systems have been based upon varying the heat transfer coefficient h by varying the volume of coolant (with on/off nozzles) since the distance from the nozzles to the roll, as well as the spray-angles, are always fixed by virtue of the nature of the hardware.

Figure 10:
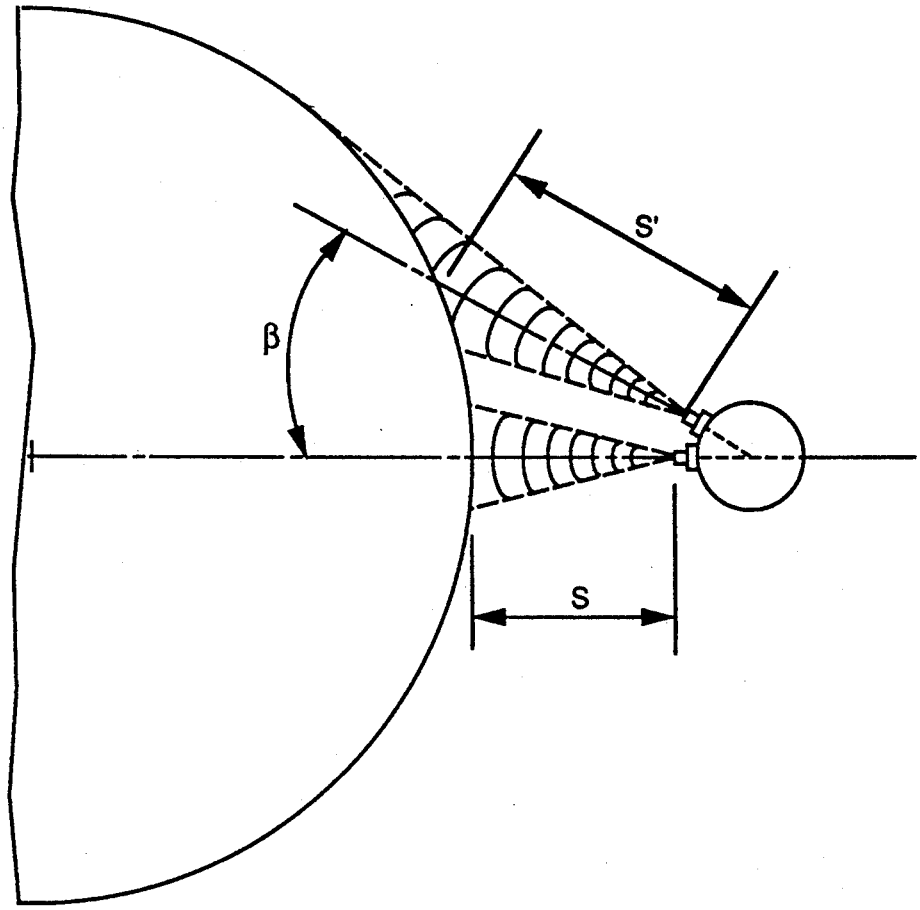
FIG. 10 is a schematic representation illustrating the spray-angle $\beta$ and spray-distance S with reference to a roll being cooled.
Figure 11:
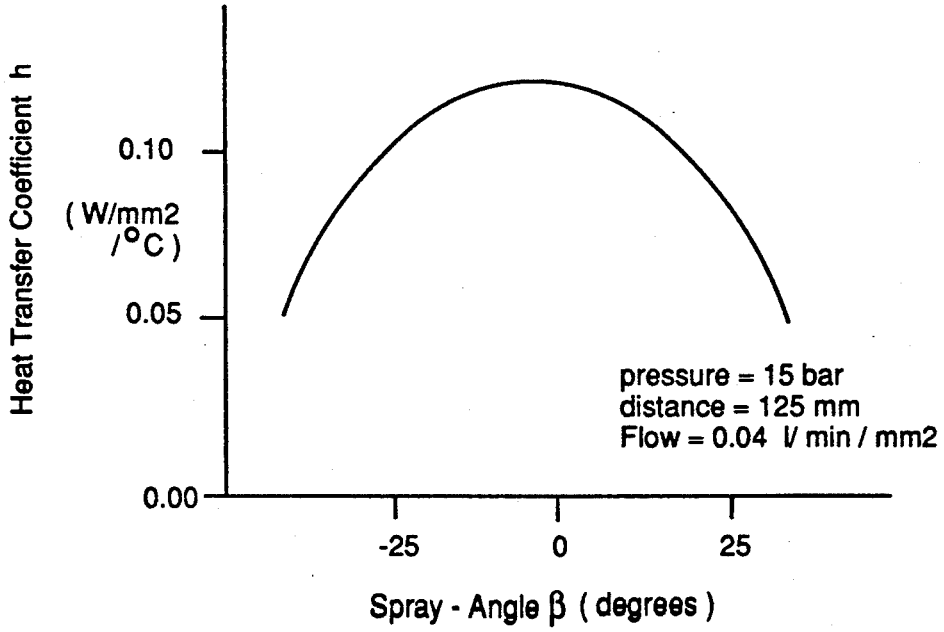
FIG. 11 is a graph showing the relationship of heat transfer coefficient as a function of spray-angle $\beta$.

This invention is based in part on maintaining a fixed volume of coolant spray through the all nozzles during the cooling operation, and varying the heat transfer coefficient h in various zones of the roll by selectively varying the angle of the spray $\beta$, and/or varying the spray-distance S. As utilized herein the "spray-angle" is the measured angle between an imaginary center-line of the sprayed coolant and the diameter of the roll extending through the nozzle, while the spray-distance is the distance between the outlet end of the nozzle and the roll along the imaginary center line of the sprayed coolant. The spray-angle angle $\beta$ and spray-distance S are depicted in FIG. 10, while the heat transfer coefficient h, as a function of the spray-angle $\beta$ is shown in FIG. 11. As can be seen, an increase in the spray-angle $\beta$ will also increase the spray-distance S.

The benefits to be derived by this invention become obvious when it is realized that pursuant to the practice of this invention, the spray-angles and/or spray-distances are very easy parameters to change and control with more reliability and reproducibility than is the spray volume, even when the volume control is limited to a simple on/off valved control as described above. In addition, the spray-angle $\beta$ and spray-distance S can be adjusted to optimum values or otherwise, regardless of the roll diameter. Most importantly, however, the more reliable cooling rate control apparatus disclosed herein will readily permit a reliable automatic control system which will not require any operator involvement, and the spray-angles or spray-distances of the various nozzles will be intricately and automatically adjusted on-the-fly in response to changes in the roll temperature profile and/or product flatness or profile.

Figure 1:
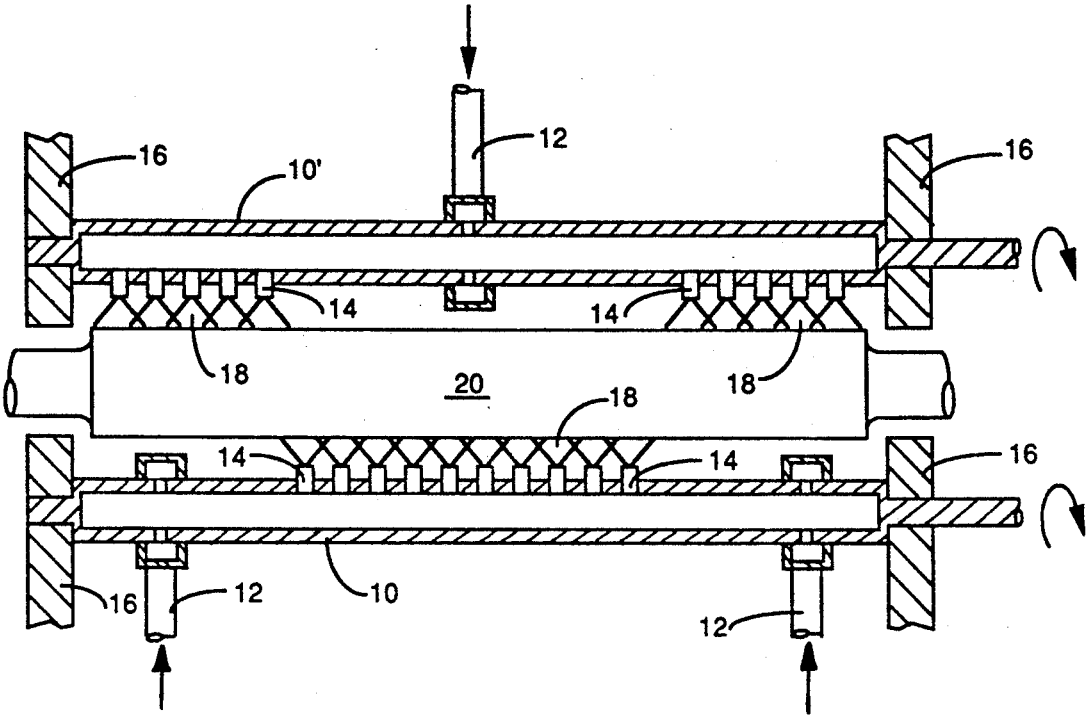
FIG. 1 is a schematic plan view of a pair of spray bars in combination with a rolling mill roll in accordance with one embodiment of this invention whereby the spray bars (shown in cross-section) are mounted for rotational movement relative to an adjacent roll.
Figure 2:
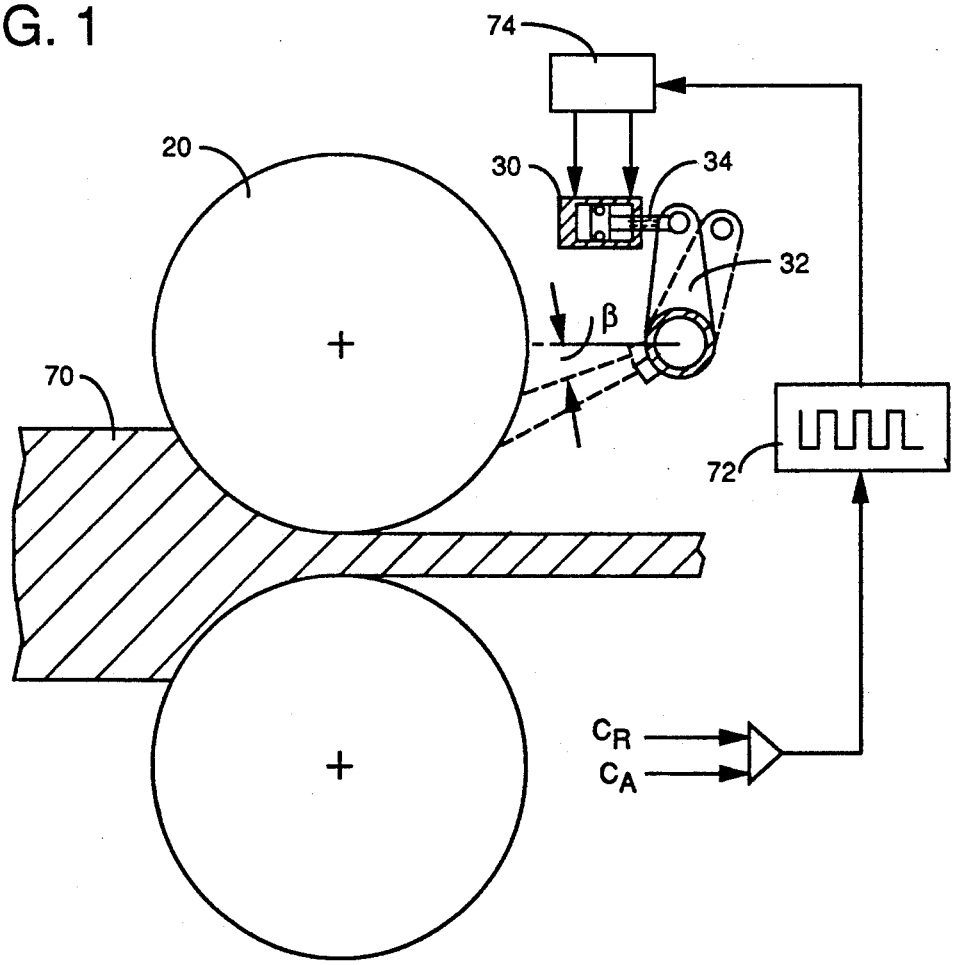
FIG. 2 is a schematic elevational view of the apparatus illustrated in FIG. 1 showing one means for causing one of the spray bar to be subjected to a rotational movement and adjustment.

Reference to FIGS. 1 and 2 will illustrate one embodiment of this invention utilizing two separate spray bars 10 and 10', at least one of which is mounted for a simple rotational movement on its axis relative to the rolling mill roll 20. As shown, the spray bars 10 and 10' comprise tubular housings each having at least one inlet means 12 and 12' respectively for admitting a coolant such as water thereinto, and a plurality of coolant outlet spray nozzles 14 and 14' respectively spaced alone the side of the tubular housings in a line parallel to the axes of both the spray bar 10 or 10', to which they are attached. Rolling mill roll 20 is positioned intermediate spray bars 10 and 10' such that the liquid coolant under pressure within the tubular housings can egress through the nozzles 14 and 14' and spray the surface of roll 20. The spray bars 10 and 10' are each mounted within bearings 16 at each end as necessary to permit their axial rotational movement. Lines 18 and 18' depict the sprays of coolant from the nozzles 14 and 14' respectively onto the roll 20 during the operation of the apparatus.

For purposes of simplifying the drawings, the two spray bars 10 and 10' are shown to be on opposite sides of the roll 20. If preferred, both spray bars could be positioned on the same side of roll 20 such that one is disposed over the other, as well as providing other arrangements.

As shown in FIG. 1, spray bar 10 is provided with a plurality of nozzles 14 only in the center portion of the spray bar for purposes of cooling only the center portion of roll 20. Spray bar 10', on the other hand, is provided with nozzles 14, only at the two outer portions of the spray bar for the purpose of cooling only the outer portions of the roll; i.e., all portion of roll 20 not cooled by the nozzles 14 on spray bar 10. If the spray-angles and spray-distances of the two sets of nozzles 14 and 14' are the same (and provided all nozzles are of equal size and equally spaced), then obviously, all the nozzles 14 and 14' will cool roll 20 at a uniform cooling rate across the width of the roll. As should be apparent, however, movement of either spray bar 10 or 10' will normally cause a change the cooling rate effected thereby. Accordingly, movement of spray bar 10 will affect a change in the cooling rate in the center portion of roll 20, while movement of spray bar 10' will cause a change in the cooling rate in the two outer portions of roll 20. By properly adjusting the position of the two spray bars 10 and 10' with reference to roll 20, a differential cooling rate can be achieved within the center portion of the roll 20 as compared to the outer portions of the roll. For most typical applications, of course, the usual adjustments will be such as to provide for a greater cooling rate within the center portion of roll 20, which as noted above, will normally be subjected to the greater heating rate, at least with regard to the hot rolling of flat rolled products.

As shown in FIG. 2, spray bar 10 is attached to a rotational drive means 30 sufficient to permit the spray bar 10 to be rotated on its axis for the purpose of varying the spray-angle $\beta$. While the drive means could be provided in any one of many different forms, the example depicted in FIG. 2 comprises a hydraulic cylinder which can be activated to rotate the spray bar 10 in either direction. Specifically, the spray bar 10 is provided with a rigidly secured lever arm 32 which is pivotally attached to the reciprocating arm 34 of hydraulic cylinder 30, so that activation of hydraulic cylinder 30 will result in a pushing or pulling action on the end of lever arm 32 thereby causing spray bar 10 to be rotated within bearings 16 in either direction for the purpose of changing the spray-angle $\beta$ and thereby changing the over-all cooling rate effected by the coolant sprays 18 emerging from nozzles 14; i.e., changing the cooling rate within the center portion of roll 20. Although not essential to the advantageous use of this embodiment of the invention, as will be discussed below, spray bar 10, is also preferably provided with a pivotal drive means for the purpose of being able to change the cooling rate within the two outer portions of roll 20. By providing a drive means 30 only with respect to spray bar 10, one can at least control the cooling rate within the center portion of the roll relative to the cooling rates within the two outer portions. For some applications, this may be all that is necessary.

In operation, a liquid coolant is provided under pressure to the interior of each spray bars 10 and 10, by any means, such as inlet conduits 12 and 12' communicating with the inside of spray bars 10 and 10' respectively. Obviously, the outside ends of the two spray bars should be sealed or capped as necessary to prevent any axial loss of coolant. The coolant under pressure within spray bars 10 and 10' will be forced to egress via nozzles 14 and 14', which are oriented to spray the coolant onto the surface of roll 20 to be cooled.

As should be apparent from the above description, the primary object of this embodiment is to provide a means for cooling the center portion of the roll which is adjustably independent from the means for cooling the outer portions so that the center portion can be cooled at a different, or at least an increased rate in contrast to the two outer portions. With this in mind, it should be apparent that a number of different arrangements could be created to achieve this goal. A preferred practice, as noted above, is to provide both spray bars 10 and 10' with rotational drive means so that each spray bar can be rotationally adjusted to independently control the cooling rates in the center portion of the roll and in the two outer portions of the roll. In an alternative approach, the rotational position of spray bar 10' can be fixed so that the nozzles 14, will achieve a given cooling rate less than that obtainable at the center portion so that only spray bar 10 is adjustable to cool the center portion of the roll at a rate essential to maintain a uniform, overall roll temperature. This technique may require a closer nozzle spacing on spray bar 10 than on spray bar 10', for example, so that a greater cooling rate can be achieved in the center portion of the roll. As one alternative, the position of spray bar 10' can be such that the spray-angles and/or spray-distances are less than optimum so that spray bar 10 can be rotated through positions that will achieve a greater cooling rate. As should be apparent, numerous other arrangements could be made whereby either one or both of the spray bars 10 and 10' could be adjustable to achieve a differential cooling rate within the center portion of the roll as contrasted to the two outer portions, or to create different cooling zones each of which is provided with an independently controllable spray bar. For example, three such spray bars can be provided to achieve a pair of intermediate cooling zones between the center portion and the two outer portions.

Figure 3:
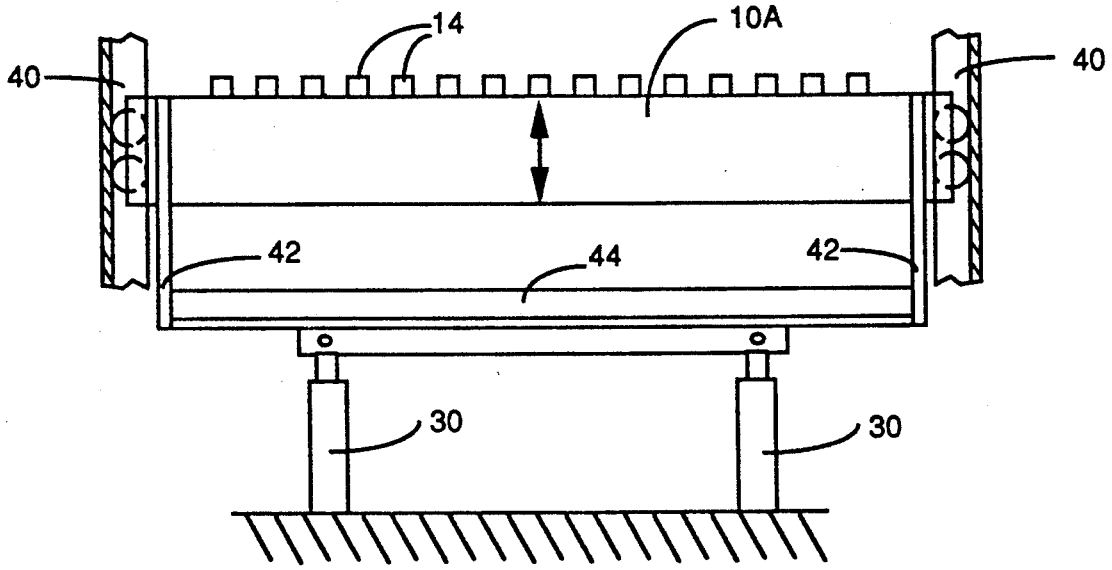
FIG. 3 is another schematic elevational view of apparatus comparable to that illustrated in FIG. 1 showing one means for causing a spray bar, for example, one of the spray bars depicted in FIG. 1, to be subjected to a translational movement and adjustment in a plane, which may be horizontal, vertical or inclined.

As an alternative to the above described rotational drive means depicted in FIG. 2, another embodiment is to utilize a reciprocating drive means sufficient to permit either or both the spray bars 10 and 10, to be moved in a plane, either horizontally towards or away from roll 20, or vertically along the side of roll 20, or even within an inclined plane, for the purpose of varying both the spray-distance S and the spray-angle $\beta$. While again the drive means could be provided in any one of many different forms, a pair of hydraulic cylinders or linear stepper motors can be utilized to achieve such planer adjustment. Reference to FIG. 3 illustrates a pair of stepper motors 30' which can be activated to move the spray bar vertically up or down along the side of roll 20, or horizontally towards or away from the roll, or even in an inclined plane which combines both a horizontal and vertical displacement. As can be seen, the two ends of the movable spray bar 10A are secured between a pair of arms 42 of frame structure 44. The arms 42 are nested within parallel channels 40 sufficient to permit plainer movement. The position of parallel channels 40 can be such that the translational movement of the spray bar 10A therebetween will be horizontal, vertical or otherwise. Activation of stepper motors 30' will cause the frame structure 44 to be moved within a plane defined by channels 40, to thereby translationally move spray bar 10A and thereby uniformly change the spray-angle $\beta$ and/or the spray-distances S of each nozzle thereon.

In FIG. 3, the relative position of the rolling mill roll and the nozzles on the spray bar 10A have not been shown since these will vary depending upon whether to motion is horizontal, vertical or otherwise. Therefore, FIG. 3 can be representative of plan view showing horizontal movability, an elevational view showing vertical movability, or something intermediate the two.

It should be readily apparent that numerous other structures could be devised for causing the spray bar 10A to be raised or lowered, or moved horizontally while the axes of the roll 20 and spray bar 10A are maintained in a parallel relationship. Clearly, any relative motion of one spray bar with reference to the roll 20, whether the motion is linear or rotational or a combination of such motions, can be utilized to change spray-angles $\beta$ and the spray-distances S and thereby vary the cooling rate in that portion of the roll 20 cooled by the spray bar so moved.

While the above-described embodiments utilize two spray bars for the purpose of being able to achieve two different cooling rates, it should be apparent that more than two such spray bars could be utilized to achieve more than two independently controllable cooling zones. For example, if one end portion of the roll has a tendency to be heated to a greater extent than the other, spray bar 10' can be divided into two independently controllable portions to create differential cooling rates within the two end portions.

Figure 4:
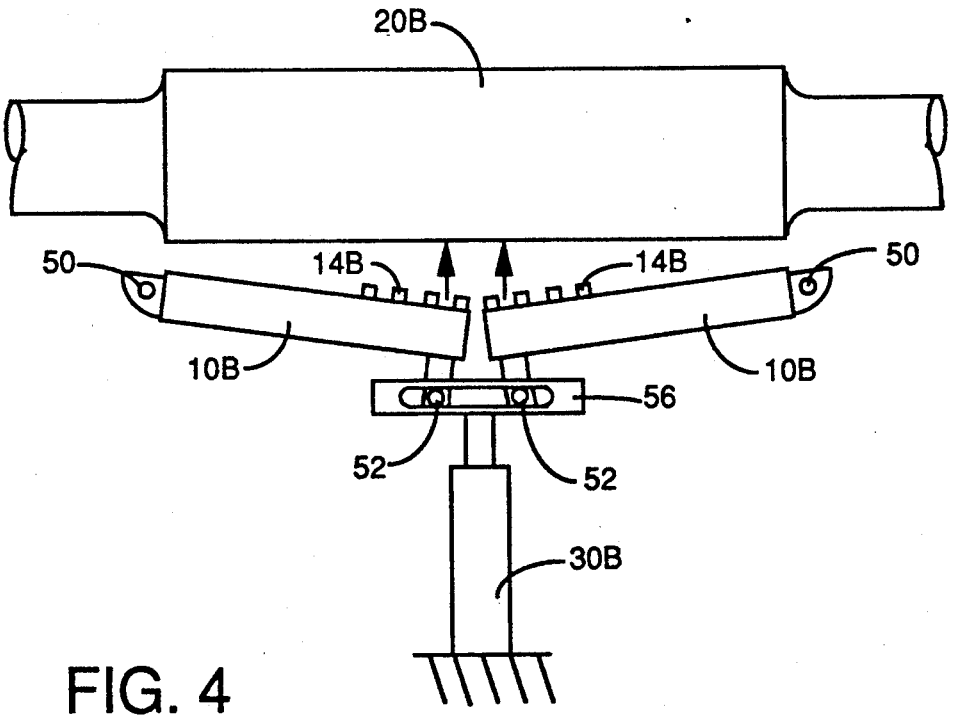
FIG. 4 is a schematic plan view of a two-piece spray bar arrangement in combination with a rolling mill roll in accordance with another embodiment of this invention whereby both portions of the spray bar are mounted for simultaneous pivotal movement and adjustment in a horizontal plane relative to the adjacent roll.

Reference to FIG. 4 will illustrate another embodiment of this invention that can be utilized to effect a differential cooling rate across the surface of a rolling mill roll whereby two spray bars, or at least a two-piece spray bar is provided, each piece of which is mounted for pivotal motion. As shown in FIG. 4, the spray bar is divided at the mid-point into two portions, namely 10B and 10B', with each portion provided with an equal number of spray nozzles 14B. As shown, each spray bar portion 10B and 10B, is provided with a flexible conduit means 12B for admitting a coolant, while the inside end of each is sealed to prevent loss of coolant at the mid-point. The outside end of each spray bar portion 10B and 10B' is pivotally mounted to a rigid structure (not shown) at pins 50 for the purpose of permitting each portion to be pivoted about pins 50 in a horizontal plane. Obviously, the pivotal movement could be provided in planes other that horizontal.

As in the case of the first embodiment described above, a drive means must be provided for the purpose of effecting the pivotal movement of the two spray bar portions. While again the drive means could be provided in any one of many different forms, the example depicted in FIG. 4 comprises a linear type stepper motor 30B which can be activated to push or pull the two inside ends of the spray bar portions 10B and 10B' as necessary to achieve the pivotal motion. As shown in FIG. 4, each inside end of the two spray bar portions is provided with a rigid post 52 which extend through slot 54 in drive plate 56. Drive plate 56 is attached to the reciprocating arm of stepper motor 30B, so that activation of stepper motor 30B will result in a pushing or pulling action on posts 52 to thereby cause the inside ends of each spray bar half 10B and 10B' to be uniformly pivoted towards or away from roll 20B for the purpose of uniformly changing the spray-angle $\beta$ and non-uniformly changing the spray-distances S, and thereby changing the over-all cooling rate effected by each of the coolant sprays nozzles 14B. While the embodiment shown depicts an arrangement where the inside ends of the two spray bar portions pivot about pinned outside ends, obviously, comparable results could be achieved by the reverse arrangement, namely, pivoting the outside ends of each spray bar about pins positioned at the inside ends. In the embodiment as illustrated, however, any pivotal motion through a given angle will cause the inside portions of the two spray bar halves to be moved through a greater distance thereby effecting a grated change in cooling rate at the center portion of the roll, as compared to the outer portions.

As can readily be seen in FIG. 4, the pivotal movement of the spray bar portions 10B and 10B' as described will result in a uniform change of the spray-angles of each nozzle 14B, while the spray-distances will change non-uniformly with the magnitude of change being in direct proportion to the distance the nozzle is spaced from the pivot point. Accordingly, the rate of change of the cooling rate will normally be greater at the center point of roll 20B and diminish proportionally moving towards the edge of the roll. Therefore, any change in the pivotal position of spray bar portions 10B and 10B', will effect a greater change in the cooling rate at the center of roll 20B with a proportionally diminishing change in cooling rate at points moving away from the center and towards the pivot point.

While the rotational motion described hereinbefore basically changes the spray-angle $\beta$, and the plainer motion basically changes the spray-distance S, it should be realized that because the spray contact surface of the roll being cooled is curved, that either form of movement or adjustment will normally effectively change both the spray-angle and spray-distance. The only exception to this is that a horizontal plainer motion will not change the spray-angle if the spray-angle happens to be zero.

Figure 5:
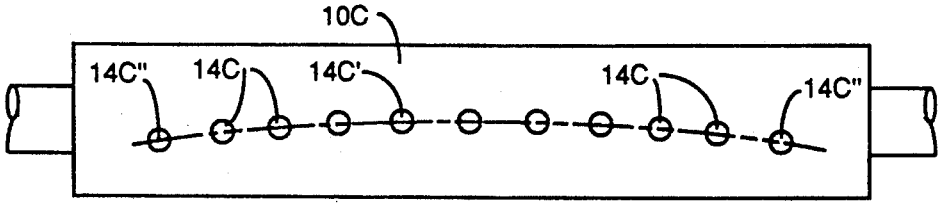
FIG. 5 is a schematic, elongated, side view of a spray bar in accordance with still another embodiment of this invention whereby the spray nozzles are positioned along a curved line on the side of the spray bar so that each nozzle will spray coolant at a slightly different spray-angle than the next adjacent nozzle.

Reference to FIG. 5 will illustrate a further embodiment of this invention which, in its most basic form, utilizes a single spray bar 10C spanning the full width of the adjacent roll 20C (shown in FIG. 6), which is adjusted by a simple rotational motion about its axis. As shown in FIG. 5, spray bar 10C comprises a tubular housing having at least one inlet means (not shown) for admitting a coolant such as water thereinto, and a plurality of coolant outlet spray nozzles 14C spaced alone the side of the tubular housing such that the liquid coolant under pressure within the tubular housings can egress through the nozzles 14C and spray coolant onto the surface of an adjacent roll 20C. As in the case of the first described embodiment, the spray bar 10C should be mounted within bearings (not shown) as necessary to permit rotational movement of the spray bar 10C on its own axis. Unlike the first-described embodiment, however, the nozzles 14C are not spaced in a straight line parallel to the spray bar axis, but rather are spaced along a curved line which forms an arc with respect to a straight line parallel to the axis, the apex of which is at the center of the spray bar 10C, or at least at the center of the roll 20C to be cooled, substantially as shown. Accordingly, one or two nozzles 14C are positioned at the center of the spray bar in an axially alined arrangement to form the apex of the arc. The two nozzles adjacent to that or those at the apex are each off-set by a small angle from that (those) at the apex. Each succeeding nozzle on each side of the center positioned closer to the edge of the roll is off-set by a proportionally larger angle so that as a result, a curved or arcuate configuration (or even a "V" configuration) is achieved substantially as shown.

When the spray bar 10C as shown in FIG. 5, is utilized to cool an adjacent roll, the spray-angle or angles $\beta$ at the center of the roll will be at one given value, while the spray-angles effected by the nozzles spaced away from the center will be progressively off-set at increasing or decreasing spray-angles, and therefore, a non-uniform cooling rate is effected across each half width of the roll 20C.

Figure 6:
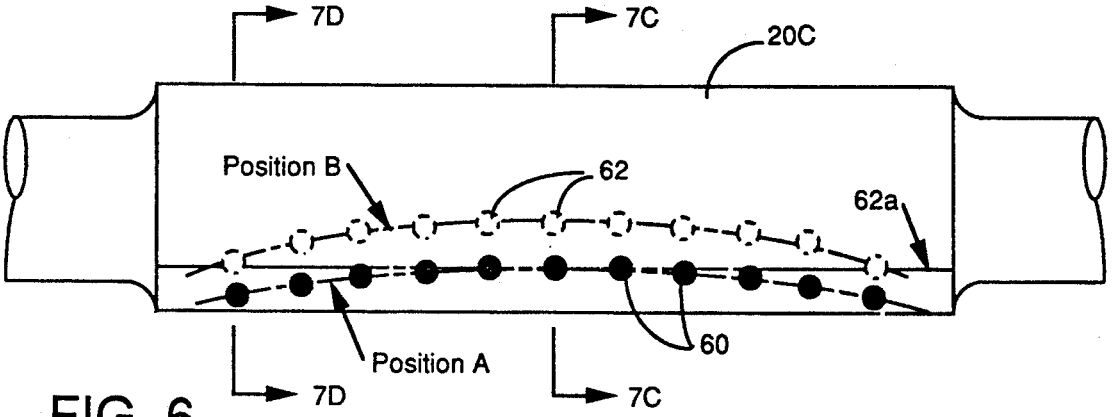
FIG. 6 is a schematic, elongated, side view of a rolling mill roll illustrating the relative position of the adjacent spray nozzles at two different rotational positions of the spray bar when utilizing the spray bar illustrated in FIG. 5.

FIG. 6 schematically illustrates the surface of a roll 20C, while each solid circle 60 thereon schematically depicts the relative positions of the various nozzles 14C adjacent thereto at a given particular rotational position of spray bar 10C (hereinafter referred to a "Position A"). Assuming that the solid straight line 62 across the surface of roll 20C represents the location at which the optimum spray-angle $\beta$ is achieved at the surface of the roll 20C to maximize the cooling rate, then the nozzle (or nozzles) 14C' at the center of the roll 20C (i.e., those depicted by the solid circles representative of Position A) will effect a maximum cooling rate at the center of roll 20C, while those nozzles spaced away from the center will effect a progressively reduced cooling rate in proportion to their distance from the center.

Reference to the four cross-sections shown in FIG. 7 will illustrate the relative positions of the center and end nozzles at the two Positions A and B. FIG. 7A and 7B illustrate the spray bar at Position A with FIG. 7A showing the section at D through the center nozzle 14C', and FIG. 7B showing the section at C through an end nozzle 14C''. FIG. 7C and 7D illustrate the spray bar at Position B with FIG. 7C showing the section at D through the center nozzle 14C', and FIG. 7D showing the section at C through an end nozzle 14C''. As shown in FIGS. 7A and 7B, the position of center nozzle 14C' at Position A is at the optimum spray-angle $\beta'$(with respect to a vertical plane) while the end nozzles 14C'' are at a spray-angle $\beta'+$ (with respect to a vertical plane) which is greater than the optimum spray angle. All those nozzles between the center nozzle 14C' and each outermost nozzle 14C'' will provide intermediate cooling rates between the maximum effected by nozzle 14C' and the minimum effected by nozzle 14C''.

Figure 7A:
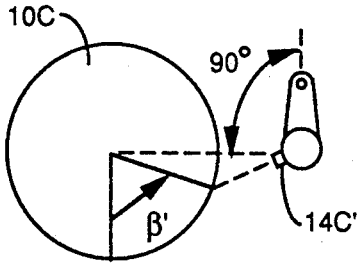
FIGS. 7A–7D are schematic cross-sectional side views through sections C and D of FIG. 6, and illustrate the relative relationships of a spray nozzle at the mid-point and end-points at two different rotational positions, thereby showing an optimum spray-angle (FIGS. 7A and 7D) in contrast to those at a spray-angle less than optimum (FIGS. 7B and 7C).
Figure 7C:
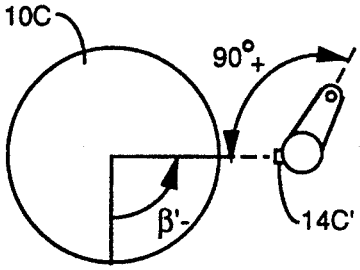
Figure 7B:
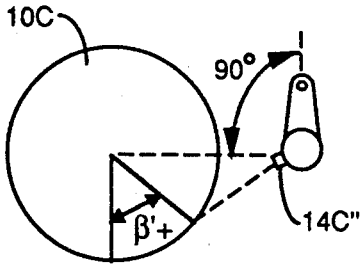
Figure 7D:
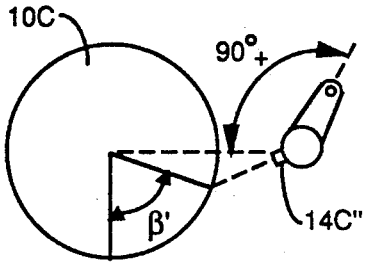

At rotational Position B, however, as shown in FIGS. 7C and 7D, the end nozzles 14C" are at the optimum spray-angle $\beta'$(with respect to a vertical plane) while the center nozzles 14C' is at a spray-angle $\beta'$—(with respect to a vertical plane) which is less than the optimum spray angle. As should be apparent, when the spray bar is positioned at Position A (as indicated by the solid circles 60), the cooling rate effected at the center of the roll 20C will be at a maximum value, with a progressively lower cooling rate effected at roll portions closer to the edge.

When spray bar 10C is rotated to position the nozzles higher than above described, as represented by the dashed circles 62 in FIG. 6 (hereinafter referred to as "Position B"), then the center nozzle 14C' will be at a spray angle which is less than optimum, as depicted in FIG. 7C. As can be seen in FIG. 6, this rotation will cause the outermost nozzles 14C" to be positioned over line 62*a*, so that these nozzles are at the optimum spray-angle as shown in FIG. 7A.

Figure 12:
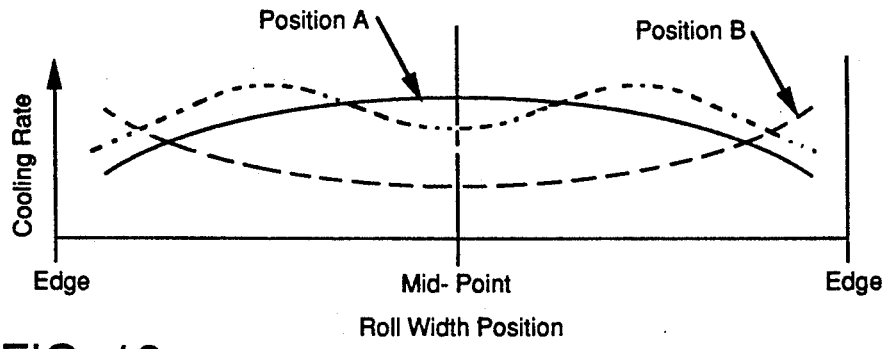
FIG. 12 is a graph plotting cooling rate against the roll width position, illustrating the relative cooling rates achieved by the spray bar illustrated in FIG. 5 at three selected different rotational positions.

Reference to FIG. 12 will graphically illustrate the cooling rate profile effected across the width of the roll 20C. As can be seen, FIG. 12 is a graph plotting the cooling rate with respect to the roll width position. The solid curve on the graph represents the cooling rate profile across the width of the roll for the situation as described above when the nozzles are at Position A (represented by the solid circles 60). At Position A, the cooling rate is greater at the center of the roll with progressively lower cooling rates at positions spaced away from the center of the roll and closer to the edge.

In view of the above description, it should be readily apparent that if the spray bar 10C were rotated so that the nozzles would move downward with respect to the roll (in affect increasing each spray-angle), that each nozzle 14C would effect a lower cooling rate, so that the solid line depicted in the graph of FIG. 12 would merely be shifted downward. This situation is not depicted in either FIG. 6 or 12. However, if the spray bar were rotated in the opposite direction the results would be quite different. That is to say, since the nozzle 14C' adjacent to the center of the roll 20C is at the optimum spray-angle for maximum cooling rate (i.e., at Position A) any rotation of the spray bar 10C from that position will cause that nozzle at the optimum spray-angle to be rotated to a position which is less than optimum, and thereby reduce the cooling rate effected thereby. If such upward rotation should be continued so that the two outermost nozzles 14C" are positioned at the optimum spray-angle to achieve the maximum cooling rate, as depicted by the dashed circles 62 in FIG. 6, namely "Position B", obviously then, the maximum cooling rate would be achieved at the two ends of the roll, with a reduced cooling rate at positions closer to the center of the roll. This condition is also illustrated in FIG. 12 by the dashed line which graphically represents the cooling rate profile across the surface width of roll 20C when the relative position of the nozzles are at Position B (as depicted of the dashed circles 62). FIG. 7C illustrates the relative position of nozzle 14C' after such a rotation to Position B.

If the spray bar 10C were rotated to some intermediate position between the two extremes discussed above (the cooling rates of which are represented by the solid and dashed lines in FIG. 12), the maximum cooling rate will be effected by a pair of nozzles disposed between the center and outermost positions. While such a position is not depicted in FIG. 6, it is depicted by the dotted line in FIG. 12, which represents just one such intermediate position.

In view of the above discussions, it should be readily apparent that spray bar 10C, can be positioned to achieve a maximum cooling rate at the center of the roll, or at any two positions uniformly spaced between the center each outer end. While the above described nozzle arrangement is representative of an ideal arrangement that will easily permit adjustment to effect a higher cooling rate at the center of the roll, as is necessary to cool rolls in the hot rolling of flat rolled products, it should be readily apparent that modified nozzle position arrangements could be devised to achieve any particular cooling rate variation across the surface of the roll as may be essential to solve particular problems.

If essential to increase the cooling rate in any one of the above embodiments, two or more such spray bars as described can be utilized with regard to any one roll. In addition, the nozzle spacing can be varied as necessary to permanently increase or decrease the cooling rate obtained in any given portion of the roll. Indeed, practically any cooling rate control can be devised by combining and/or varying any of the above described embodiments.

Figure 8:
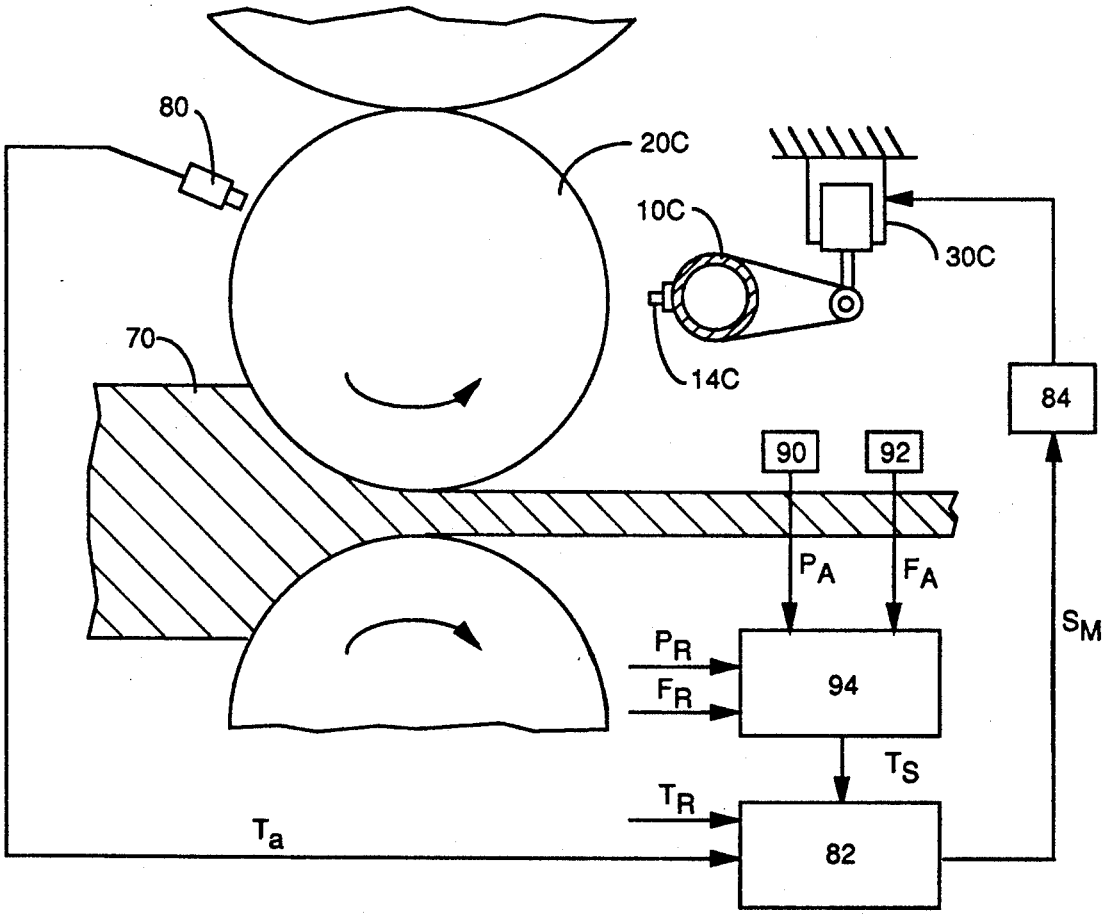
FIG. 8 is a schematic diagram illustrating one embodiment of the in-process control circuit of this invention in combination with a rotational spray bar as illustrated in FIGS. 1 and 4, as may be utilized to cool the top roll in a roll stand for the rolling of flat rolled products such as plate, strip or sheet products.

While the drawings illustrate the relationship of one or more spray bars with regard to a single roll; e.g., the top roll in a conventional two roll stand (as shown in FIGS. 2 and 8), it should be appreciated that comparable spray bars will normally be provided adjacent to the lower roll, which for purposes of drawing simplification, are not illustrated in any of the figures. In addition, the closed-loop control systems described below will normally be the same for each spray bar; i.e., those cooling the upper as well as the lower roll or rolls.

Figure 14A:
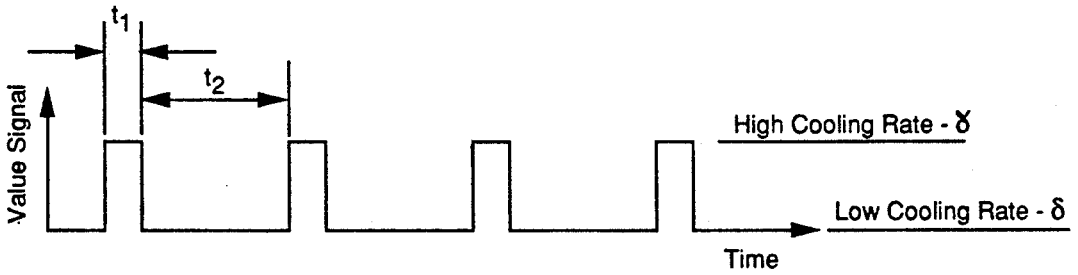
FIGS. 14A, 14B and 14C are graphs illustrating three different variations plotting nozzle positions at maximum cooling rate and minimum cooling rate as a function of time to illustrate how a wide variety of overall cooling rates can be achieved by utilizing just two different nozzle or spray bar positions.
Figure 14B:
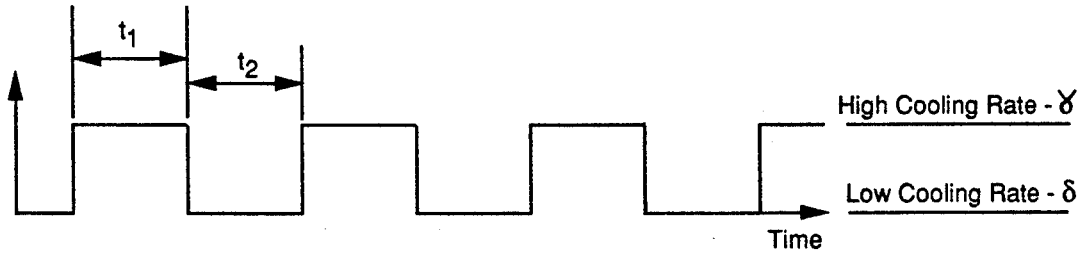
Figure 14C:
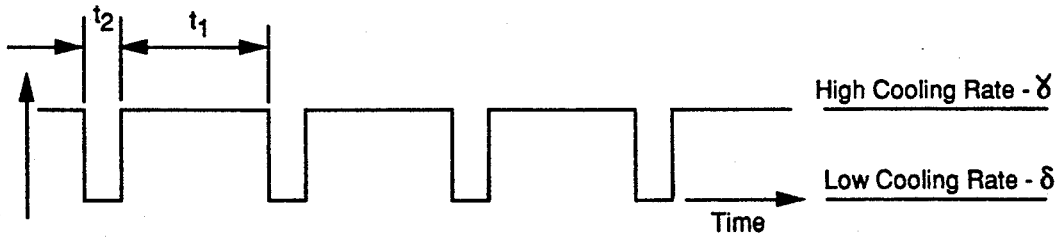

With regard to the closed-loop control systems for controlling the above described apparatus, it will be required that a parameter indicative of the temperature and/or physical profile of the roll and/or work product be continuously monitored for the purpose of determining the need for any change in cooling rate within the various zones of the rolls or work product. In response to an automatic determination that such a change is necessary, the spray bar is moved to vary the position of the nozzles with respect to the roll as necessary to effect the preferred cooling rates. Depending on the type of spray bar utilized, the movement of the spray bar may either be an incremental adjustment to achieve more ideal spray-angles and/or spray-distances to approximate ideal cooling rates in the various zones of the roll, or else the spray bar may be rotated back and forth between a first position of high cooling rate and a second position of low cooling rate, whereby the time at each such position is adjusted to achieve and average ideal cooling rate in any one or more zones of the roll as necessary to maintain a predetermined average temperature within the zone. Reference to FIGS. 14A, 14B and 14C will illustrate how a wide variety of different overall cooling rates can be achieved by merely moving any one nozzle or group of nozzles back and forth between a position of optimum or high cooling rate and a position of reduced or low cooling rate. As depicted in these figures, $\alpha$ represents the nozzle or nozzles at a position of high cooling rate, (e.g., a spray-angle $\alpha$ of high cooling rate) which is maintained during time $t_1$, while $\delta$ represents the same nozzle or nozzles at a position of low cooling rate (e.g., a spray angle $\delta$ of low cooling rate) which is maintained during time $t_2$. The horizontal axes of the graphs represent time. As shown in FIG. 14A, a relatively low overall cooling rate is achieved by reducing the amount of time, $t_1$, the nozzle or nozzles are at a position of high cooling rate $\alpha$ with respect to the time, $t_2$ the nozzle or nozzles are at a position of low cooling rate, $\delta$. FIG. 14C, on the other hand, is illustrative of a situation for achieving a high overall cooling rate where the nozzle or nozzles are at a position of high cooling rate $\alpha$ for a time $t_1$ which is significantly longer than time $t_2$ during which time the nozzle or nozzles are at a position of low cooling rate, $\delta$. FIG. 14B is representative of an intermediate situation where times $t_1$ and $t_2$ are approximately equal to achieve an intermediate overall cooling rate.

Reference to FIG. 2 will illustrate one embodiment of a closed loop feed-back system for controlling the apparatus illustrated in FIGS. 1 and 2, utilizing the two position spray bar technique noted above. As shown in FIG. 2, an elevational cross-section of a rolling operation is schematically illustrated, where a pair of rolls are in the process of rolling a metal workpiece 70. As can be seen, the thickness of workpiece 70 is being reduced by the rolls, as the workpiece passes between the rolls from left to right as depicted in the drawing. Also 10 schematically illustrated in FIG. 2 is a section through spray bar 10, one nozzle 14 and the associated hardware for rotating the spray bar 10; i.e., a lever arm 32 and its pivotal drive mean, namely a hydraulic cylinder 30, as described above.

In its simplest form as depicted in FIG. 2, the control system comprises a controller 72 which activates valve 74 to extend or retract hydraulic cylinder 30 between its two extreme positions, and thereby rotate the nozzles 14 to a position of high cooling rate at spray-angle $\alpha$, or to a position of low cooling rate at spray-angle $\sigma$. A cooling rate reference signal $C_R$ is supplied to controller 72 which is indicative of the overall cooling rate of the roll as necessary to maintain the desired temperature, as well as the actual cooling rate, $C_A$, as can be determined be a number of means, as will be discussed below with reference to FIG. 8. The controller 72, which includes a microprocessor, then determines the time duration the nozzles 14 should remain at spray-angle $\alpha$ and at spray-angle $\sigma$ so that the overall cooling rate will be that on which the cooling rate reference signal $C_R$ is based. Based on this determination, controller 72 generates a signal to activate valve 74 thereby controlling the duration of time the nozzles 14 are at each of the two respective positions. The cooling rate reference signal $C_R$ can be provided in a variety of different forms, such as a cooling rate program based on prior experience in rolling a the same product.

As noted above, reference to FIG. 8 will illustrate another embodiment of a closed loop feed-back system for controlling the apparatus described above, and particularly the apparatus illustrated in FIG. 5. As shown in FIG. 8, an elevational cross-section of a rolling operation is schematically illustrated, where a pair of rolls are in the process of rolling a metal workpiece 70'. As can be seen, the thickness of workpiece 70' is being reduced by the rolls, as the workpiece passes between the rolls from left to right as depicted in the drawing. Also schematically illustrated in FIG. 8 is a section through spray bar 10C, one nozzle 14C and the associated hardware for rotating the spray bar 10C; i.e., a lever arm 32C and its pivotal drive mean, namely a stepper motor 30C, as described above. With regard to the closed loop feed-back system shown in FIG. 8, the system represents a cross-section through one nozzle 14C.

In its simplest and broadest aspect, the control system of FIG. 8 comprises a plurality of sensors 80 (only one is shown) rigidly positioned adjacent to the roll 20C for monitoring a roll condition which is a function of the heat absorbed by the roll, such as a pyrometer for monitoring the actual roll temperature $T_a$ itself. Other parameters that could be monitored are roll profile or thermal expansion. A roll temperature or profile controller 82 is provided for receiving the signal $T_a$ from sensor 80 (e.g. pyrometer) and comparing that signal $T_a$ to a programmed value; i.e., a reference temperature $T_R$ and determine whether the roll temperature is increasing or decreasing, (or whether the roll is undergoing thermal expansion, etc.) as well as determining the magnitude of any such monitored changes. When controller 82 determines that a change in the monitored parameter; e.g., roll temperature, has been sufficient that a change in the cooling rate profile is necessary, it transmits a signal $S_M$ to motor controller 84 which then activates the stepper motor, or whatever drive means 30C is utilized, thereby causing drive means 30C to push or pull lever arm 32C and thereby rotate spray bar 10C and nozzles 14C either upwardly or downwardly as necessary to change the spray-angles and accordingly the resulting cooling rate achieved by each of the nozzle. Typically, and particularly in the case of rolling flat rolled products, the only changes that will need to be made are changes in the relative cooling rates between the center portion and two outer portions of the roll as well as perhaps an overall change in cooling rates as may be necessary to maintain an average lower temperature across the roll width. As shown above, spray bar 10C will be capable of being positioned to achieve either objective.

A more preferred closed loop feed-back system would further include means which responds not only to changing roll conditions but also to changes in the rolled product, as is also shown in FIG. 8. Such a system includes sensors 90 and/or 92 on the exit side of the roll to continuously monitor workpiece characteristics, such as the actual workpiece profile $P_a$, and/or the actual workpiece flatness $F_a$. While use of either one of the sensors 90 or 92 alone is operable, it is preferred that both sensors be provided for optimum control purposes. The sensors 90 and 92 provide continuous or repeating signals, $P_a$ and $F_a$, to a workpiece profile and/or flatness controller 94. A variety of such profile and flatness sensors are well known to those skilled in the art. It should be sufficient to note that a number of differing types of sensors can be utilized for these applications such as capacitive, ultrasonic, magnetic flux, eddy current, and other types of sensors all of which have been utilized for measuring flatness and profile and providing a continuous signal indicative of the measured parameter.

The workpiece profile and flatness controller 94 receives the signals $P_a$ and $F_1$, from sensors 90 and 92 respectively, and compares those actual values to the reference or desired values $P_R$ and $F_R$ programmed into the controller 94. The controller 94 is programmed to produce a reference roll temperature $T_S$, as determined from the workpiece profile and flatness measurements; i.e., $P_a$ and $F_1$, and transmit the signal $T_S$ to the roll temperature or profile controller 82. Roll profile controller 82 then compares $T_R$ and $T_S$ to $T_a$, and produces signal $S_M$ to motor controller 84 based on the compared values. As previously described, motor controller 84 activates the drive means 30C, when signaled to do so, to change the spray-angles of nozzles 14. All of the above mentioned controllers are conventional analog or digital data processors which are capable of construction and programming by anyone skilled in the art.

Figure 9:
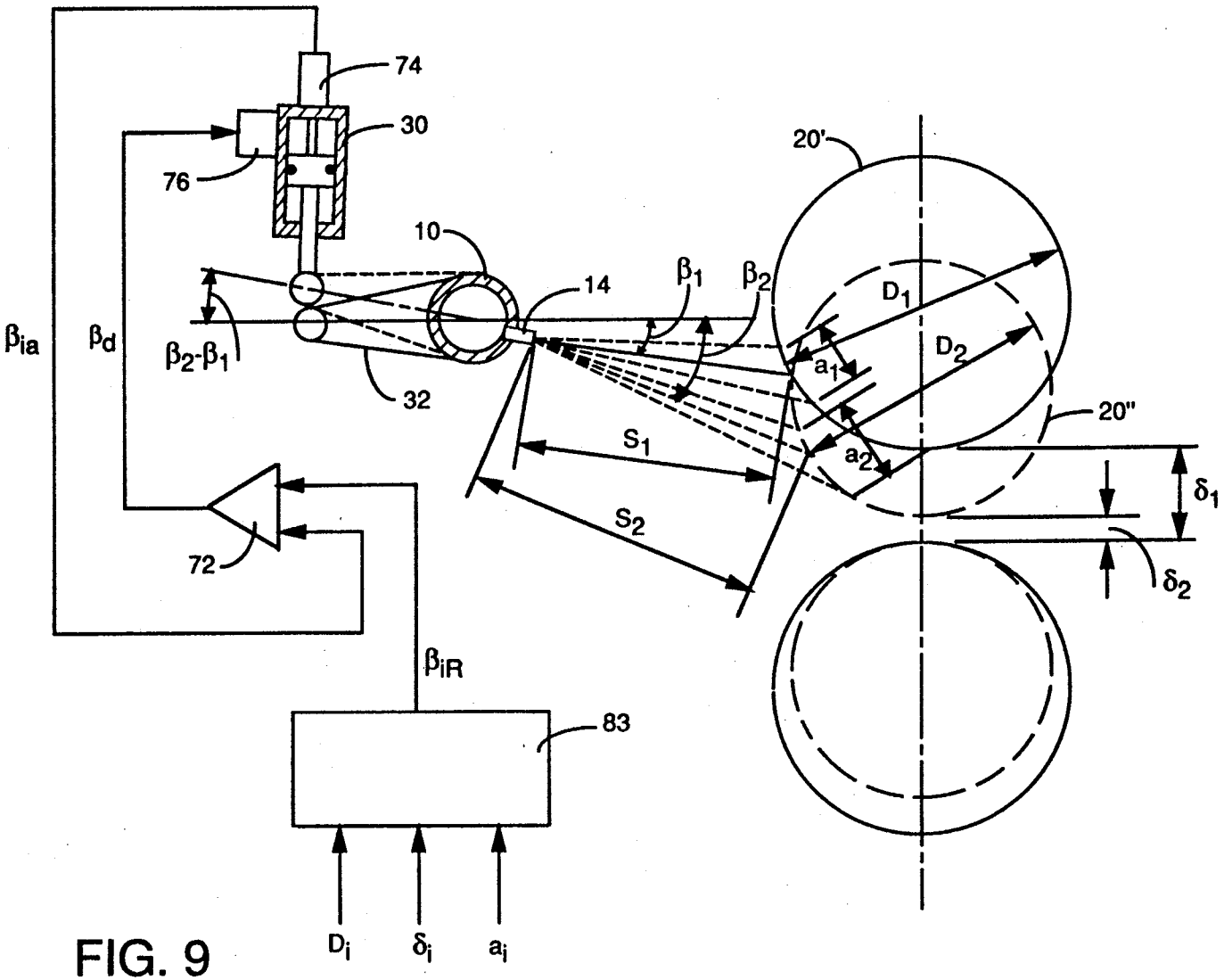
FIG. 9 is schematic diagram illustrating one embodiment for a control circuit for controlling the relative spray-angles $\beta_1$ and $\beta_2$ and relative spray-distance $S_1$ and $S_2$ as variable functions of roll diameter D and roll gap $\delta$.

In contrast to the in-process controls as described above and illustrated in FIGS. 2 and 8, FIG. 9 illustrated one embodiment of a control circuit as utilized to adjust the rolls to achieve an optimum cooling effect after making a roll change to rolls of a different diameter D and/or changing the roll gap. As shown in FIG. 9, an elevational cross-section of a roll stand is schematically illustrated, depicting rolls of two different diameters, $D_1$ and $D_2$, and two different roll gaps $\delta_1$ and $\delta_2$.

With regard to the control system shown in FIG. 9, the system represents a cross-section through one thermal control zone of rolls 20' and 20'', and accordingly one nozzle 14. Unlike the in-process control system described above, where the overall control system adjusts the spray bar to vary the cooling rates within different portions of the roll, the control system as depicted in FIG. 9 will normally adjust the spray bar as necessary to be properly reposition the nozzles relative to a newly inserted top roll having a different diameter, and/or a newly adjusted roll gap. As shown, the spray bar optimum angle $\beta_1$ corresponds to the roll diameter $D_1$, roll gap $\delta_1$, and coolant contact zone $a_1$, while spray bar optimum angle $\beta_2$ corresponds to the roll diameter $D_2$, roll gap $\delta_2$, and coolant contact zone $a_2$.

In its simplest and broadest aspects, the control system of FIG. 9 comprises a microprocessor 83 which calculates the optimum angle reference $\beta_{ir}$ in response to $D_i$, $\delta_1$, and $\alpha_i$, which is data fed into the microprocessor 83 regarding the new roll diameter $D_i$ and/or new roll gap $\delta_i$ and the predetermined preferred contact zone $a_i$ for rolls of that diameter. In calculating the optimum angle reference $\beta_{ir}$, microprocessor 83 takes into account the relationships between the heat transfer coefficient and spray-angle position $\beta_i$ and distance $S_i$, and transmits the signal $\beta_{ir}$ to a position regulator 72. The actual spray-angle $\beta_{ia}$ is monitored by a monitoring means 74, such as a position transducer, and is conveyed as a signal $\beta_{ia}$ to position regulator 72. Position regulator 72 compares the signals $\beta_{ir}$ and $\beta_{ia}$ and generates a signal $\beta_d$ proportional to the difference between $\beta_{ir}$ and $\beta_{ia}$, and is conveyed to controller 76. In response to signal $\beta_d$, controller 76 will drive reciprocating means 30 to position nozzles 14 as necessary to achieve $\beta_{ir}$. In the event reciprocating means 30 is a hydraulic piston, as previously described, controller 76 can comprise a servo-valve that will admit or withdraw hydraulic fluid from the cylinder as necessary to reposition the all nozzles. In most conventional roll stands the bottom roll is fixed, and only to top roll is adjustable to vary the roll gap $\delta$. Therefore, only a single control as depicted in FIG. 9 for varying the spray-angle with regard to the top roll is all that will normally be necessary for this application.

Figure 13:
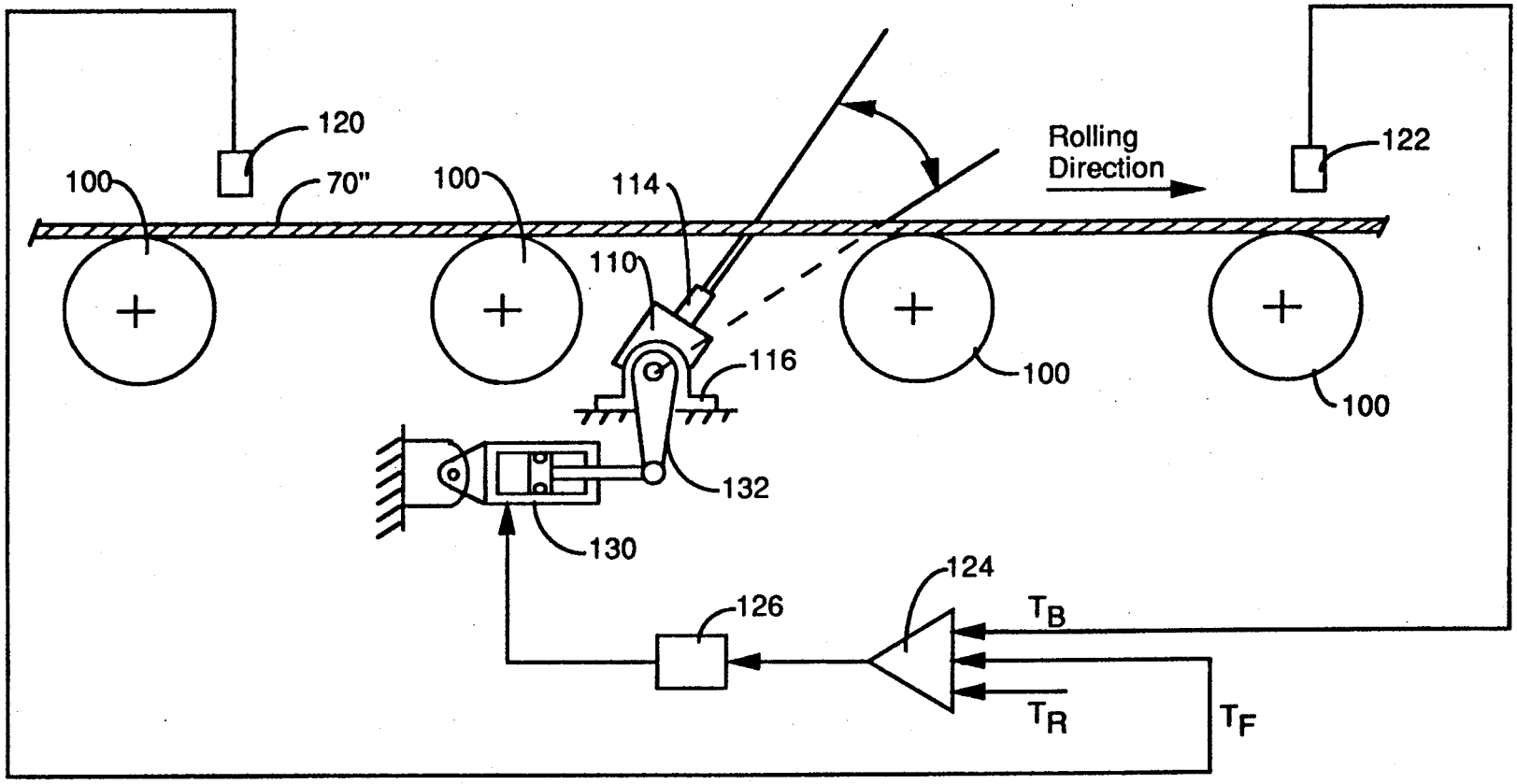
FIG. 13 is a schematic elevational view of a hot rolling operation wherein a spray bar, substantially as shown in FIGS. 1 or 5, is being utilized to cool a hot rolled product as it moves along a roll-out table.

As previously noted, any of the above described embodiment of this invention could be utilized to cool the flat rolled product or workpiece emerging from the hot roll stand as well as a rolling mill roll, as described, to achieve the same beneficial results. The process of this invention would be particularly advantageous in achieving a controlled cooling of the hot rolled product for purposes of achieving a more uniform cooling rate as may be necessary to effect a uniform microstructure across the width of the product, and accordingly more uniform physical properties. As in the case of the rolling mill roll as noted above, the resulting hot rolled product will also retain more heat in the center portion of the product which often results in a difference in grain size and microstructure near the center as contrasted to the edges. Accordingly, a zone controlled cooling will serve to minimize any such difference in grain size and microstructure. Reference to FIG. 13 will illustrate one embodiment of such application which illustrates an elongated cross-section through a roll-out table after a workpiece 70'' has been hot rolled and is moving across the roll-out table (i.e., rolls 100) from left to right as viewed in the drawing. While any of the above described spray bars could be utilized in this application to effect comparable results, FIG. 13, illustrates a preferred embodiment where a spray bar 110, preferably having "waterwall" type nozzles 114, is mounted at bearings 116 as necessary to permit its rotational motion about its axis. As in the case of the above described embodiments, a drive means 130 is provided to controllably rotate spray bar 110. While again the drive means 130 could be provided in any one of many different forms, a hydraulic cylinder or linear stepper motor can be utilized to achieve such rotational adjustment. Reference to FIG. 13 illustrate a stepper motor which can be activated to rotate the spray bar 110 on its axis to thereby uniformly change the spray-angle $\beta$ and the spray-distances S of each nozzle 114. Clearly, any relative motion of the spray bar with reference to the rolled product 70'', whether the motion is vertical or rotational or pivotal or a combination of such motions, can be utilized to change spray-angles $\beta$ and the spray-distances S effected by the nozzles and thereby vary the cooling rate in that portion of the hot rolled product as described above with regard to the rolling mill roll.

The closed-loop control system schematically shown in FIG. 13 comprises a front pyrometer 120 which monitors the temperature $T_F$ of the product as it emerges from the roll and a back pyrometer 122 which monitors the temperature $T_B$ of the product after it has been cooled, whereby signals $T_F$ and $T_B$ are fed to a controller 124. A reference temperature $T_R$ is also supplied to controller 124. Accordingly, controller 124 compares the temperatures $T_F$ and $T_B$ as contrasted to $T_R$, and regulates servo valve 126 as necessary to adjust drive means 130 as necessary to position spray bar 110 to cool the product as desired. Typically, such a system will monitor product temperature at the center portion of the product as will as the two edge portions, so that the cooling rate within the center portion can be controlled independent of the cooling rate in the two edge portions. Ideally, the spray bar used could be either two spray bars as depicted in either FIGS. 1 and 4, or a single spray bar having nozzles arranges in a curved alignment as depicted in FIG. 5. Since the operation, function and controls of such spray bars have already been described in detail above, further discussion thereof is unnecessary here.

Figure 15:
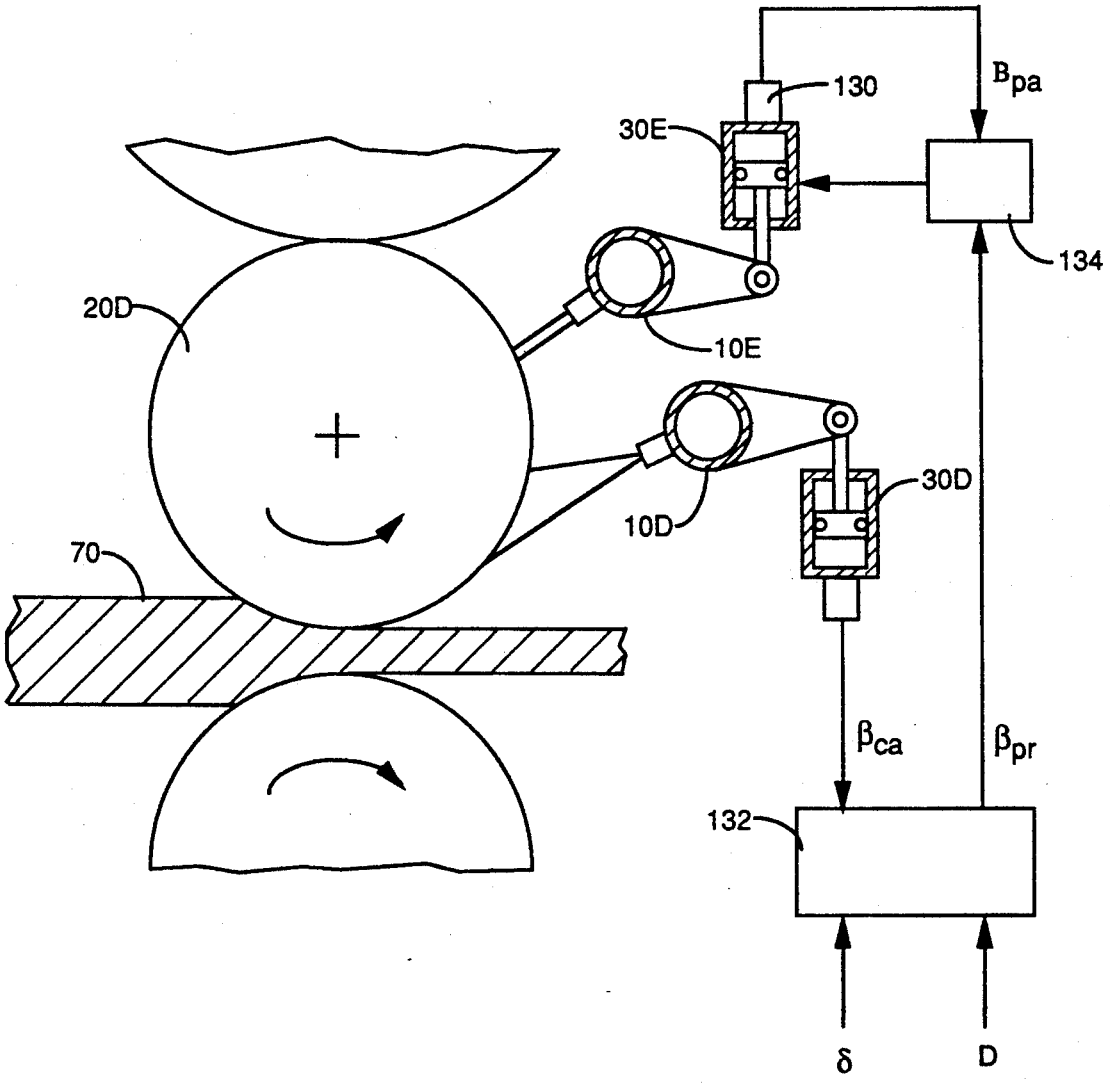
FIG. 15 is a schematic elevational view of apparatus substantially like that shown in FIG. 2 except that two rotationally adjustable spray bars are provided.

In view of the above description, it should be readily apparent that a great number of modifications and alternate embodiments could be utilized without departing from the spirit of the invention to provide very useful techniques for more accurately and reliably cooling rolling mill rolls or hot rolled products either manually or automatically which cannot be achieved by any prior art technique. In addition, one or more of the processes and apparatus of this invention can be utilized in combination with one or more other roll cooling or treating techniques to achieve combined beneficial results. For example, any one of the above described techniques for cooling a rolling mill roll can beneficially be combined with a second or additional spray bar which can serve multiple purposes, such as a polishing header, as shown in FIG. 15. As shown in FIG. 15, a movable spray bar 10D is movably positioned adjacent to rolling mill roll 20D. While spray bar 10D may be mounted for rotational, pivotal or translational movement in accordance with any of the embodiments disclosed above, FIG. 15 illustrates the spray bar 10D mounted for rotational movement substantially in accordance with the embodiment disclosed above and shown in FIG. 2. Accordingly, spray bar 10D is selectively rotated during rolling to control the cooling rate of the roll 20D substantially as described above. In addition to spray bar 10D, a second spray bar or header 10E is also provided. The function of spray bar 10E, however, can be varied to achieve differing purposes, or a combination of purposes. As a first option, spray bar 10E can be set up to spray coolant in much the same manner as does spray bar 10D for the purpose of further cooling roll 20D. To have any beneficial effect in this application, however, the spray parameters of spray bars 10D and 10E should be somewhat reduced so that together they do not overcool the surface of roll 20D. In this way, that portion the roll surface being subjected to cooling is expanded over an increased segment of the roll 20D, so that the total overall area subjected to cooling is increased, as is the time span during which cooling effected. Clearly, therefore, the use of two such spray bars would serve to reduce the cooling rate to which the roll surface is subjected.

As an alternative to the above-described function of spray bar 10E, this spray bar can be utilized primarily as a roll polishing spray bar; i.e., to spray water onto the surface of roll 20D at exceptionally high pressure and low flow densities for the purpose of removing mill scale and other oxide particles from the surface of the roll. Indeed, it has been found that utilizing water pressures between 1000 and 2000 psi (70 to 140 bars) will provide a sufficient hydro-mechanical force to dislodge mill scale and oxide particles from the surface of the roll that would otherwise be dislodged during the following rolling operation and possibly rolled-in on the surface of the workpiece. Such a high pressure low flow density jet spray would, of course, provide some cooling effect on the surface it impinges upon, so that the two functions are not completely distinct, and in either function, spray bar 10E will serve to further cool the roll surface.

When using spray bar 10E as a polishing spray bar, the nozzles through which the coolant is sprayed can be in accordance with conventional cooling spray nozzles, or, in the alternative, the coolant can be sprayed through narrow slots through the wall of the spray bar body. The efficiency of the polishing sprays can be increased by applying ultrasonic waves to the sprayed coolant. When used in combination with one or more other coolant spray bars as shown if FIG. 15, the angular position of such polishing spray bar should be such that the polishing jet of coolant should be sufficiently spaced from any other coolant spray to avoid interference between the two sprays and thereby optimize each objective.

In operation, the position of spray bar 10E is adjusted with cylinder 30E, and the angular position is measured by position transducer 130. The position reference $\beta_{pr}$ of the cylinder 30E is calculated by microprocessor 132 based the roll gap $\beta$ and the roll diameter D and the actual position of the cylinder 30 which adjusts toe position of spray bar 10D. Microprocessor 132 activates controller 134 to rotate cylinder 30E to adjust spray bar 10E as calculated to be necessary.

I claim:

1. A spray bar for use in combination with apparatus for cooling a rolling mill roll comprising; an elongated tubular member, means for delivering a liquid coolant into said elongated tubular member, and a plurality of spaced spray nozzles each adapted to spray such liquid coolant from within said tubular member onto a surface of such rolling mill roll, said nozzles disposed in a curved alignment, so as to form an arc with respect to a straight line parallel to the axis of said spray bar, along a surface of said spray bar so that each adjacent nozzle effects at least one of a different spray-angle and different spray-distance thereby achieving different cooling rates within different portions of such rolling mill roll, said tubular member adapted for movement with respect to such rolling mill roll to change cooling rates effected by said nozzles.

2. A spray bar according to claim 1 in which said curved alignment is an arcuate curved alignment having an apex adjacent to a center portion of such rolling mill roll to thereby effect a cooling rate which varies uniformly from such center portion of such rolling mill to an edge portion or such rolling mill roll.

3. A method of controllably cooling a flat rolled product upon emerging from a hot roll stand comprising; providing a spray bar having a plurality of spaced coolant spray nozzles positioned thereon, said nozzles being spaced along the surface of said spray bar in a curved alignment, so as to form an arc with respect to a straight line parallel to the axis of said spray bar, such that, at any particular position of said spray bar, the spray-angles and spray-distances effected by the nozzles are not the same and effect different spray-angles and/or different spray-distances to achieve different cooling rates within different portions of such hot rolled product, positioning the spray bar adjacent to such emerging hot rolled product so that said nozzles are adjacent to and spaced across a width of such hot rolled product, admitting a liquid coolant into said spray bar such that the coolant will be continuously sprayed through each of said nozzles and onto a surface of such hot rolled product at a given spray-angle and a given spray-distance to cool such hot rolled product, and controlling a cooling rate of such hot rolled product be effecting a controlled movement of said spray bar sufficient to change each of said spray-angles and/or each of said spray-distances and thereby change said cooling rate effected by each of said nozzles.

4. A method according to claim 3 in which said spray bar movement is a translational movement in a plane as will effect at least a change in the spray-distances effected by said nozzles.

5. A method according to claim 3 in which said spray bar movement is a rotational movement as will effect at least a change in the spray-angles effected by each of said nozzles.

6. A method according to claim 3 in which said spray bar movement is a combination of two movements selected from the group consisting of translational movement in a plane and rotational movement.

7. Apparatus for use in combination with a flat rolled product emerging from a hot roll stand for cooling such hot rolled product comprising; a spray bar having a plurality of spray nozzles secured to a surface thereof, said nozzles being spaced along the surface of said spray bar in a curved alignment, so as to form an arc with respect to a straight line parallel to the axis of said spray bar, so that, at any particular position of said spray bar, the spray-angles and spray-distances effected by the nozzles are not the same and effect different spray-angles and/or different spray-distances to achieve different cooling rates within different portions of such hot rolled product, means for admitting a liquid coolant into said spray bar such that such coolant will egress from said spray bar through said nozzles to impact on a surface of such hot rolled product at given spray-angles and given spray-distances as necessary to effect a given cooling rate, drive means for causing a movement of spray bar sufficient to change said spray-angles and/or said spray-distances as necessary to change the cooling rates effected by said nozzles.

8. Apparatus according to claim 7 in which said drive means causes a translational movement of said spray bar in a plane as will effect at least a change in the spray-distances effected by said nozzles.

9. Apparatus according to claim 7 in which said drive means causes a rotational movement of said spray bar as will effect at least a change in the spray-angles effected by said nozzle.

10. Apparatus according to claim 7 in which said drive means causes a movement which is a combination of two movements selected from the group consisting of translational movement in a plant and rotational movement.

11. Apparatus according to claim 7 further including a control means automatically controlling said spray bar, said control means including a front monitoring means or monitoring the temperature of such hot rolled product before it is cooled, a back monitoring means for monitoring the temperature of such hot rolled product after it has been cooled, and a controller which adjust the spray bar in response to signals from said front monitoring means and said back monitoring means as compared to a reference temperature.

12. A method of differentially cooling different selected portions of a rolling mill roll comprising; providing a plurality of cooling spray nozzles on a spray bar adjacent to such rolling mill roll such that different nozzles are adapted to cool different selected portions of such rolling mill roll at a predetermined spray-angle and spray-distance, and such that those nozzles adapted to cool at least a first of such selected portions of such rolling mill roll are positioned so that at least one of such spray-angle and such spray-distance is different from that effected by nozzles adapted to cool at least a second of such selected portions of such rolling mill roll, said nozzles on said spray bar being spaced along a surface of said spray bar in a curved alignment, so as to form an arc with respect to a straight line parallel to the axis of said spray bar, such that, at any particular position of said spray bar, the spray-angles and spray-distances effected by adjacent nozzles are not the same and effect at least one of different spray-angles and different spray-distances to achieve different cooling rates within different portions of such rolling mill roll, admitting a continuous flow of liquid coolant through all of said nozzles and onto a surface of such rolling mill roll, and controlling a cooling rate within at least such first selected portions of such rolling mill roll by effecting a uniform controlled movement of all nozzles adapted to cool such first selected portion to uniformly change at least one of said first spray-angle and said first spray-distance effected by such moved nozzles to thereby change the cooling rate within at least said first selected portion of the rolling mill roll.

13. A method according to claim 12 in which said controlled movement is a translational movement in a plane.

14. A method according to claim 13 in which said translational movement is in a generally horizontal plane to thereby move the nozzles on said spray bar towards or away from such rolling mill roll.

15. A method according to claim 13 in which said translational movement is in a generally vertical plane to thereby move the nozzles on said spray bar generally vertically along a side of such rolling mill roll.

16. A method according to claim 12 in which said controlled movement is a rotational movement as will effect at least a change in the spray-angles effected by the nozzles on said spray bar.

17. A method according to claim 12 in which said controlled movement is a combination of two movements selected from the group consisting of translational movement in a plane and rotational movement.

18. A method according to claim 12 in which said controlled movement is a movement to either one of two positions, a first position of high cooling rate and a second position of low cooling rate.

19. A method according to claim 18 in which a preferred cooling rate is effected by moving said spray bar back and forth between such two positions and varying the time during which said spray bar remains at each position.

20. A method according to claim 12 in which a roll condition is monitored, and said spray bar is subjected to said controlled movement as necessary to change the cooling rate within different portions of the roll as necessary to minimize any undesired roll condition.

21. A method according to claim 20 in which said roll condition is temperature profile of the roll.

22. A method according to claim 20 in which said roll condition is thermal expansion of the roll.

23. A method according to claim 12 in which a workpiece being rolled is continuously monitored to determine a rolled characteristic, and said spray bar is subjected to said movement as necessary to change the cooling rate within different portions of the rolling mill roll as necessary to minimize any undesired rolled characteristic of such workpiece.

24. A method according to claim 23 in which said rolled characteristic is flatness.

25. A method according to claim 23 in which said rolled characteristics is profile.

26. A method according to claim 23 in which both a roll condition and a workpiece rolled characteristic are monitored.

27. Apparatus for use in combination with a rolling mill roll for differentially cooling different selected portions of such rolling mill roll comprising; a plurality of coolant spray nozzles adapted to spray a liquid coolant onto a surface of such rolling mill roll whereby different nozzles are adapted to cool differed selected portions of such rolling mill roll, and such that the nozzles for cooling at least a first of such selected portions are spaced along a surface of an elongated spray bar adjacent to such rolling mill roll, the nozzles on the spray bar being spaced along a surface of the spray bar in a curved alignment, so as to form an arc with respect to a straight line parallel to the axis of said spray bar, so that, at any particular position of said spray bar, the spray-angles and spray-distances effected by the nozzles are not the same and effect different spray-angles and-or different spray-distances to achieve different cooling rates within different portions of such rolling mill roll, means for admitting a continuous flow of liquid coolant to each of said nozzles so that the coolant will egress from said nozzles and impact on a surface of such rolling mill roll at predetermined spray-angles and spray-distances, and at lest one of such spray angles and spray-distances can differ for nozzles cooling differing selected portions of such rolling mill roll as necessary to effect differing predetermined cooling rates within differing selected portions of such rolling mill roll, drive means for causing a controlled movement of said spray bar sufficient to change at least one of such spray-angles and spray-distances of the nozzles thereon as necessary to change the cooling rates effected within at least such first selected portion.

28. Apparatus according to claim 27 in which said drive means is adapted to cause a controlled translational movement of said spray bar in a plane as will effect at least a change in the spray-distances effected by the nozzles thereon.

29. Apparatus according to claim 28 in which said drive means is adapted to cause a controlled translational movement generally in a horizontal plane to thereby move the nozzles on said spray bar towards or away from such rolling mill roll.

30. Apparatus according to claim 26 in which said drive means is adapted to cause a controlled translational movement generally in a vertical plane to thereby move the nozzles on said spray bar generally vertically along the side of such rolling mill roll.

31. Apparatus according to claim 27 in which said drive means is adapted to cause a controlled rotational movement of said spray bar as will effect at least a change in the spray-angles effected by the nozzle thereon.

32. Apparatus according to claim 27 in which said drive means is adapted to cause a controlled movement which is a combination of two movements selected from the group consisting of translational movement in a plane and rotational movement.

33. Apparatus according to claim 27 in which said spray bar is movable to either one of two positions, a first position of high cooling rate and a second position of low cooling rate.

34. Apparatus according to claim 27 in which such curved alignment is an arcuate alignment having an apex at a mid-portion of such rolling mill roll sufficient to achieve a given cooling rate at such mid-portion of such rolling mill roll and a different cooling rate in portions of such rolling mill roll spaced away from such mid-portion.

35. Apparatus according to claim 27 further including an automatic means for automatically activating said drive means for causing said controlled movement of said spray bar.

36. Apparatus according to claim 35 in which said automatic means comprises a means for monitoring a roll condition which is a function of heat absorbed by such rolling mill roll and producing a first signal indicative of such heat absorbed, control means for receiving such first signal and comparing it to a reference value of said roll condition, and when said comparison is indicative of a need to change the cooling rate of such rolling mill roll, producing a second signal, and a controller for receiving such second signal and causing said means for controlling said spray bar, to move said spray bar to thereby change at least one of such spray-angles and such spray-distances and effect a change of the cooling rate achieved thereby.

37. Apparatus according to claim 36 in which said means for automatically controlling said spray bar comprises a means for monitoring a workpiece being rolled to monitor a rolled characteristic which is a function of the heat absorbed by such roll and producing a first signal indicative of such heat absorbed, control means for receiving such first signal and comparing it to a reference value of such roll condition, and when said comparison is indicative of a need to change the cooling rate of such rolling mill roll, producing a second signal, and a controller for receiving such second signal and causing said means for moving said spray bar to move said spray bar and thereby change at least one of such spray-angles and such spray-distances and effect a change of the cooling rate achieved thereby.

38. Apparatus according to claim 36 is which said means for automatically controlling said spray bar comprises both a means for monitoring a roll condition and a means for monitoring a workpiece rolled characteristic.

39. Apparatus according to claim 36 in which said spray bar is movable to either one of two positions, a first position of high cooling rate and a second position of low cooling rate, and said means for automatically controlling said spray bar includes a controller adapted to move said spray bar back and forth between such two positions, said controller consisting of a microprocessor adapted to receive a cooling rate reference signal $C_R$ and determine a time duration at which said spray bar is to remain at each of such two positions to achieve an overall cooling rate indicated by such cooling rate reference signal.

40. Apparatus according to claim 39 in which such cooling rate reference signal is the second signal produced by said control means.

41. Apparatus according to claim 39 in which such cooling rate reference signal is a cooling rate program based on prior experience in rolling like products.

42. Apparatus according to claim 27 further including means for causing said movement of said spray bar in response to a change in rolling conditions including a change in roll diameter and/or a change in roll gap.

43. Apparatus according to claim 42 in which said means for causing a movement of said spray bar includes a microprocessor adapted to receive input information regarding a change in rolling conditions, and calculate an optimum nozzle spray-angle for said changed rolling condition, and signaling said drive means to move said spray bar and change the spray-angles of the nozzles to such optimum spray-angle.

44. Apparatus according to claim 43 further including a position regulator and a means for monitoring an angular position of said nozzles, whereby said position regulator receives a signal from said monitor indicating the angular position of said nozzles as well as a signal from said microprocessor, and signals said drive means to move said spray bar as necessary to change the nozzle spray-angles from such monitored position to an optimum position.

* * * * *